US007773060B2

(12) United States Patent
Oh et al.

(10) Patent No.: US 7,773,060 B2
(45) Date of Patent: Aug. 10, 2010

(54) METHOD, MEDIUM, AND APPARATUS COMPENSATING FOR DIFFERENCES IN PERSISTENCE OF DISPLAY PHOSPHORS

(75) Inventors: Hyun-hwa Oh, Yongin-si (KR); Ho-young Lee, Suwon-si (KR); Du-sik Park, Suwon-si (KR); Sung-su Kim, Yongin-si (KR); Chang-yeong Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1064 days.

(21) Appl. No.: 11/483,848

(22) Filed: Jul. 11, 2006

(65) Prior Publication Data

US 2007/0013614 A1 Jan. 18, 2007

(30) Foreign Application Priority Data

Jul. 15, 2005 (KR) ..... 10-2005-0064448

(51) Int. Cl.
*G09G 3/30* (2006.01)
*G09G 3/32* (2006.01)

(52) U.S. Cl. ..... 345/77; 345/72; 345/78; 345/83; 345/690

(58) Field of Classification Search ..... 345/55–102, 345/204–214, 690–697
See application file for complete search history.

(56) References Cited

U.S. PATENT DOCUMENTS 7,227,596 B2 * 6/2007 Weitbruch et al. ..... 345/77
7,342,595 B2 * 3/2008 Chang et al. ..... 345/690
7,479,934 B2 * 1/2009 Thebault et al. ..... 345/60
2002/0140638 A1 * 10/2002 Kao et al. ..... 345/60
2004/0008161 A1 1/2004 Doyen et al.
2005/0140593 A1 * 6/2005 Chang et al. ..... 345/72
2009/0141051 A1 * 6/2009 Sun et al. ..... 345/690

FOREIGN PATENT DOCUMENTS

| | | |
|---|---|---|
| JP | 2001083925 | 3/2001 |
| JP | 2001125067 | 5/2001 |
| KR | 10-2004-0010772 | 1/2004 |
| WO | WO 01/24152 A1 | 4/2001 |
| WO | WO 02/093539 A2 | 11/2002 |

* cited by examiner

*Primary Examiner*—David L Lewis
(74) *Attorney, Agent, or Firm*—Stass & Halsey LLP

(57) ABSTRACT

A method, medium, and apparatus compensating for differences in the persistence of phosphors in a display panel. The method of compensating for differences in persistence of phosphors in a display panel, having two or more light-emitting elements with different response characteristics, may include compensating for the response time of a first light-emitting element that represents the longest response time, selecting data response time for a second light-emitting element, which is different from the longest response time, and compensating for the differences in the persistence of phosphors due to a difference between the response times of the first light-emitting element and the second light-emitting element by compensating for the selected video data based on the compensated video data for the first light-emitting element.

34 Claims, 12 Drawing Sheets

METHOD, MEDIUM, AND APPARATUS COMPENSATING FOR DIFFERENCES IN PERSISTENCE OF DISPLAY PHOSPHORS

CROSS-REFERENCE TO RELATED APPLICATIONS

This application claims priority from Korean Patent Application No. 10-2005-0064448, filed on Jul. 15, 2005, the disclosure of which is incorporated herein in its entirety by reference.

BACKGROUND OF THE INVENTION

1. Field of the Invention

Embodiments of the present invention relate at least to the compensation of phosphor persistence, and more particularly at least to a method, medium, and apparatus compensating for differences in persistence of phosphors in a display panel and a display apparatus, medium, and method displaying video data compensated for differences in persistence produced by phosphors having different response times.

2. Description of the Related Art

Recently, with the growing interest in high definition television (HDTV), development has been very active in display panels such as liquid crystal displays (LCD), plasma display panels (PDP) and organic light emitting diodes (OLED), for example.

Unlike conventional display devices, display panels, for example, are light and thin, and thus may be applied to various fields including televisions, computers, camcorders, automatic navigation systems, etc., and are therefore represent an important technology.

However, in such a display, typically phosphors emit light through three different light-emitting materials corresponding red (R), green (G), and blue (B). However, these respective phosphors have different response times, which results in phosphor persistence occurring in the front and rear of moving objects on a display screen.

For example, when a bright object moves against a dark background, color persistence occurs in front of and behind a moving object.

This phenomenon will now be explained in more detail.

FIG. 1 illustrates response times of different conventional phosphors that emit light corresponding to red (R), green (G), and blue (B) (hereinafter referred to as a "red phosphor", "green phosphor", and "blue phosphor").

As illustrated in FIG. 1, the green phosphor has the lowest (slowest) response time, the blue phosphor has the highest (fastest) response time, and the red phosphor has a response time that is intermediate of the two response times.

For example, as illustrated in FIG. 2, if a white object with a black background, in a frame $I_{(n-1)}$(201), moves in a horizontal direction in a subsequent frame $I_{(n)}$(202), an edge with a mixture of blue and red occurs in front of the moving object and a phosphor persistence with a mixture of green and red occurs behind the object.

In order to prevent this phenomenon, for example, U.S. patent application Ser. No. 2004-0169732, discusses selecting video data for the R and B light-emitting elements, which have response times that are different from the longest response time, e.g., from a G light-emitting element, and compensating video data the R and B light-emitting elements so that the difference between the response times of the R and B light-emitting elements are artificially compensated for in view of the expected response time of the G light-emitting element.

Specifically, here the discussed method includes modifying the differences in persistence of phosphors between light-emitting elements by adding a predefined quantity of persistence to the R and B phosphors, having short response times, based on the G phosphor having the longest response time. This method uses an exemplary non-linearly decreasing function given by the below Equation (1), as a coloring mode.

$$\mathrm{Corr}(x) = \frac{B_n - B_{n+1}}{255} * a * B_n * e^{-b*x*v} \tag{1}$$

Here, x denotes a pixel position in the persistence, v the length of a motion vector, $B_n$ a video value of a blue component at the current pixel position, $B_{n+1}$ a video value of a blue component at the position of a neighboring pixel, and a and b are adjustment constants.

However, according to this conventional technique, only the red phosphor and the blue phosphor, which have relatively short light-emitting times, are modified. However, if the motion is fast, a severe motion blur occurs due to the compensation of the red phosphor and the blue phosphor. In addition, when implementing such a persistence compensation using a non-linear function, using motion vectors as a parameter in the form of a lookup table (LUT), the size of the LUT would be very large to maximize performance. Embodiments of the present invention overcome these drawbacks.

SUMMARY OF THE INVENTION

Accordingly, embodiments of the present invention solve the above-mentioned conventional problems, with an aspect of embodiments being to provide a method, medium, and apparatus for compensating for differences in persistence of phosphors in a display panel and a display apparatus, medium, and method that may perform a modeling of the response characteristics of red, green, and blue phosphors, reduce the amount of motion blur for a moving object by using the direction and size of motion vectors, and remove a color edge and a phosphor persistence occurring in front of and behind the moving object.

Additional advantages, objects, and features of the invention will be set forth in part in the description which follows and in part will become apparent to those having ordinary skill in the art upon examination of the following or may be learned from practice of the invention.

To achieve the above and/or other aspects and advantages, embodiments of the present invention include a method of compensating for differences in response times of phosphors in light-emitting elements, the method including compensating data of a first light-emitting element, compensating data of a second light-emitting element that has a response time shorter than a response time of the first light-emitting element, wherein the compensating of the data of the second light-emitting element is based on a difference between the response time of the first light-emitting element and the response time of the second light-emitting element and the compensation performed on the data of first light-emitting element.

The data of the first light-emitting element may be video data and the data of the second light-emitting element may be video data.

The compensating of the data of the first light-emitting element may include reducing a level of the data based on motion vectors estimated from a current frame of the data of the first light-emitting element and a subsequent frame of the data of the first light-emitting element.

Here, the difference in response times may generate a visually noticeable color edge at a leading edge of a moving object without compensation of the data of the second light-emitting element. Similarly, the difference in response times may generate a visually noticeable color persistence at a trailing edge of a moving object without compensation of the data of the first light-emitting element.

The compensating of the data of the second light-emitting element may include calculating a difference in a quantity of emitted light between a first quantity of emitted light corresponding to the compensated data of the first light-emitting element and a second quantity of emitted light corresponding to the data of the second light-emitting element, and compensating the data of the second light-emitting element based on the calculated difference in the quantity of emitted light.

Further, the compensating of the data of the second light-emitting element may include calculating a difference in a quantity of emitted light between a first quantity of emitted light corresponding to the compensated data of the first light-emitting element and a second quantity of emitted light corresponding to the data of the second light emitting element, linearizing the calculated difference in the quantity of the emitted light, and compensating the data of the second light-emitting element based on the linearized calculated difference in the quantity of the emitted light.

The linearization of the calculated difference in the quantity of the emitted light may include linearizing based on motion vectors estimated from a previous frame of the data of the second light-emitting element and a current frame of the data of the second light-emitting element, and directional components of the motion vectors.

The first light-emitting element may also include a green phosphor, and the second light-emitting element includes a red phosphor or a blue phosphor.

To achieve the above and/or other aspects and advantages, embodiments of the present invention include a method of compensating for differences between response times of phosphors in light-emitting elements, the method including compensating for a data value of a second light-emitting element, which has a shorter response time than a response time of a first light-emitting element, based on non-phosphors response time compensated data of the first light-emitting element, and making the second light-emitting element emit a quantity of light such that, in combination with light generated by at least another light-emitting element and/or the first light-emitting element, corresponding response time differences between light-emitting elements are visually less detectable than a combination of light generated without compensation of the data value of the second light-emitting element.

The combination of light of the second light-emitting element and the at least other light-emitting element and/or the first light-emitting element may produce a gray color at a color edge, of an object, created by the second light-emitting element.

Here, the color edge may be a movement leading edge of the object.

The response time difference may generate a visually noticeable color edge at a leading edge of a moving object without compensation of the data value of the second light-emitting element.

The compensated data value may further be based on motion vectors of a corresponding moving object.

In addition, the first light-emitting element may include a green phosphor, and the second light-emitting element includes a red phosphor or a blue phosphor.

To achieve the above and/or other aspects and advantages, embodiments of the present invention include an apparatus compensating for differences in response times of phosphors in a corresponding plurality of first light-emitting elements and a plurality of second light-emitting elements, with each of the plurality of second light-emitting elements having shorter response times than each of the corresponding plurality first light-emitting elements, the apparatus including a compensating unit to compensate a data of a first light-emitting element, of the plurality of first light-emitting elements, with the data of the first light-emitting element controlling an emitting of light of the first light-emitting element, and to compensate data of a second light-emitting element, of the plurality of second light-emitting elements, with the data of the second light-emitting element controlling an emitting of light of the second light-emitting element, wherein the compensating of the data of the second light-emitting element is based on a difference between a response time of the first light-emitting element and a response time of the second light-emitting element and the compensation performed on the data of first light-emitting element.

The apparatus may further include a control unit to receive reference timing signals and to generate scan signals, and a display, including the plurality of first light-emitting elements and the plurality of second light-emitting elements, to output light based upon the generated scan signals and respective compensated pixel data having compensated data of corresponding first light-emitting elements and compensated data of corresponding second light-emitting elements.

To achieve the above and/or other aspects and advantages, embodiments of the present invention include an apparatus compensating for differences in response times of phosphors in a corresponding plurality of first light-emitting elements and a plurality of second light-emitting elements, with each of the plurality of second light-emitting elements having shorter response times than each of the corresponding plurality first light-emitting elements, the apparatus including a compensating unit to compensate for a data value of a second light-emitting element, of the plurality of second light-emitting elements, with the data of the second light-emitting element controlling an emitting of light of the second light-emitting element, with the compensation of the data value of the second light-emitting element being based on non-phosphors response time compensated data of a first light-emitting element, of the plurality of first light-emitting elements, with the data of the first light-emitting element controlling an emitting of light of the first light-emitting element, and making the second light-emitting element emit a quantity of light such that, in combination with light generated by at least another light-emitting element and/or the first light-emitting element, corresponding response time differences between light-emitting elements are visually less detectable than a combination of light generated without compensation of the data value of the second light-emitting element.

Here, the apparatus may further include a control unit to receive reference timing signals and to generate scan signals, and a display, including the plurality of first light-emitting elements and the plurality of second light-emitting elements, to output light based upon the generated scan signals and respective compensated pixel data having non-phosphors response time compensated data of corresponding first light-emitting elements and compensated data of corresponding second light-emitting elements.

To achieve the above and/or other aspects and advantages, embodiments of the present invention include a display apparatus, including a control unit to receive reference timing signals and to generate scan signals, and a display, including a plurality of first light-emitting elements and a plurality of second light-emitting elements, to output light based upon the generated scan signals and respective compensated pixel data, wherein the compensated pixel data includes compensating data of a first light-emitting element, of the first light-emitting elements, and compensating data of a second light-emitting element, of the second light-emitting elements, which has a response time shorter than a response time of the first light-emitting element, wherein the compensating of the data of the second light-emitting element is based on a difference between the response time of the first light-emitting element and the response time of the second light-emitting element and the compensation performed on the data of first light-emitting element, when the difference in the response time would generate a visually noticeable color persistence at a trailing edge of a moving object without compensation of the data of the first light-emitting element, and wherein the compensated pixel data includes compensating the data of the second light-emitting element, based on non-phosphors response time compensated data of the first light-emitting element, and making the second light-emitting element emit a quantity of light such that, in combination with light generated by at least another light-emitting element and/or the first light-emitting element, a corresponding response time difference between corresponding pixel light-emitting elements are visually less detectable than a combination of light generated without compensation of the data of the second light-emitting element, when the corresponding response time difference would generate a visually noticeable color edge at a leading edge of a moving object without compensation of the data value of the second light-emitting element.

To achieve the above and/or other aspects and advantages, embodiments of the present invention include an apparatus compensating for differences in response times of phosphors of light-emitting elements, the apparatus including a motion estimation module to estimate a first motion vector from a previous video frame and a video current frame, and to estimate a second motion vector from the video current frame and a subsequent video frame, a motion-vector direction-checking module to generate a directional component of the estimated first motion vector, and a response time-compensation module compensating for differences in response times of phosphors based on the generated directional component, the estimated first motion vector, and the estimated second motion vector, to adjust video data values of the current frame.

The response time-compensation module may include a frame scan module to scan the current frame, a front-part compensation module to receive the generated directional component of the first motion vector of the estimated first motion vector and the estimated motion vector, and to perform response time compensation on a front part of a moving object if a pixel scanned by the frame scan module is included in the front part of the moving object, and a rear-part compensation module to receive the generated directional component of the first motion vector of the estimated first motion vector and the estimated first and second motion vectors, and performing response time compensation on a rear part of the moving object if the pixel scanned by the frame scan module is included in the rear part of the moving object.

The front-part compensation module may make at least one second light-emitting element emit a same quantity of emitted light as a first light-emitting element, with a response time of the second light-emitting element being different than a response time of the first light-emitting element, by reducing the response time of the second light-emitting element.

The reduced response time of the second light-emitting element may be adjusted according to a direction of the first motion vector.

In addition, the first light-emitting element may include a green phosphor, and the second light-emitting element includes a red phosphor or a blue phosphor.

The rear-part compensation module may compensate for differences in the response time of phosphors due to a difference between response times of first and second light-emitting elements, with the response time of the first light-emitting element being longer than a response time of the second light-emitting element, by reducing a response time of the first light-emitting element, and compensates for the response time of the second light-emitting element.

The response time of the first light-emitting element may be reduced based on the second motion vector.

The rear-part compensation module may further calculate a difference in an amount of emitted light between a first light emission corresponding to the reduced response time of the first light-emitting element and a second light emission corresponding to the response time of the second light-emitting element, and compensate for the response time of the second light-emitting element based on the calculated difference in the amount of emitted light.

Still further, the rear-part compensation module may calculate a difference in an amount of emitted light between a first light emission corresponding to the reduced response time of the first light-emitting element and a second light emission corresponding to the response time of the second light-emitting element, linearize the calculated difference in the amount of emitted light, and compensate for the response time of the second light-emitting element based on the linearized calculated difference in the amount of emitted light.

The linearization may be performed using the estimated first motion vector and the generated directional component of the first motion vector.

The first light-emitting element may further include a green phosphor, and the second light-emitting element includes a red phosphor or a blue phosphor.

To achieve the above and/or other aspects and advantages, embodiments of the present invention include a display apparatus, including a video signal input unit to receive and convert a video signal of a specified form into red (R), green (G), and blue (B) signals, a response time-compensation unit to compensate for differences in response times of the R, G, and B signals, as corresponding corrected R, G, and B signals, a subfield coding unit to generate subfield code words by using the corrected R, G, and B signals, a two-frame memory to store the generated subfield code words, a serial-parallel conversion unit to collect all code words for one line from the two-frame memory and to perform an addressing according to the one line, a plasma display panel to output the corrected R, G, and B signals corresponding to the addressing, and a control unit to receive vertical and horizontal sync signals as reference timing signals and to generate scan and sustain pulse signals for control of the plasma display panel.

To achieve the above and/or other aspects and advantages, embodiments of the present invention include at least one medium including computer readable code to implement embodiments of the present invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
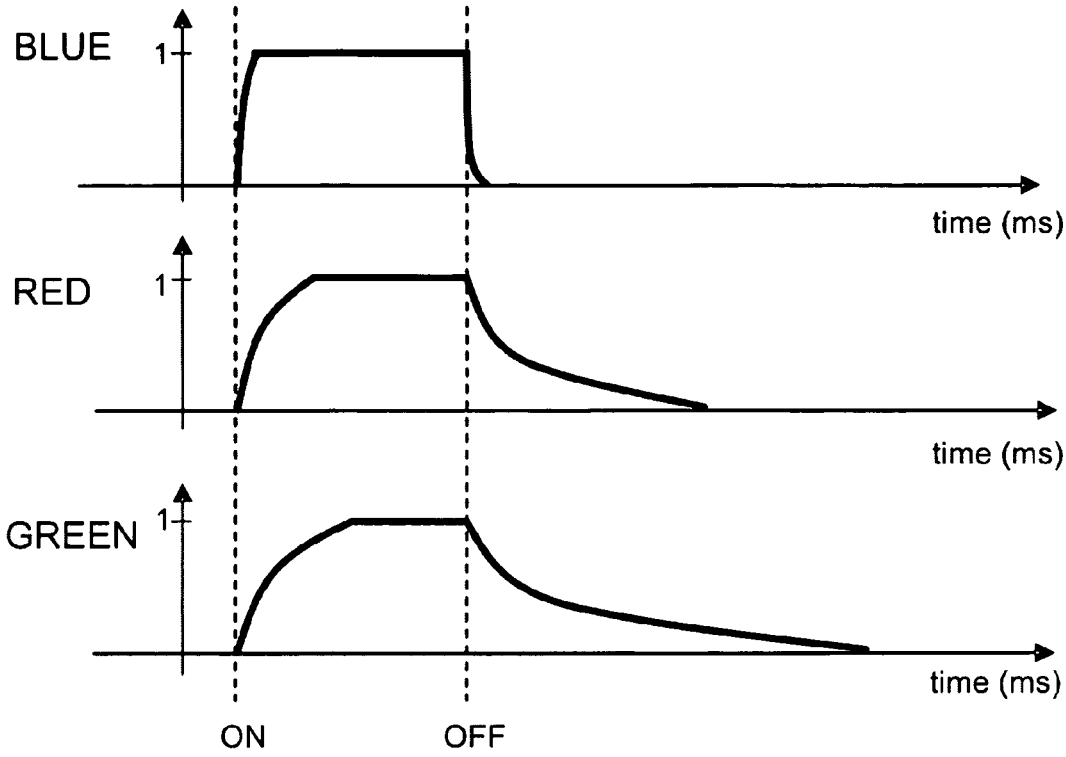
FIG. 1 (PRIOR ART)
FIG. 1 illustrates conventional response times of phosphors that emit R, G, and B light.
Figure 2:
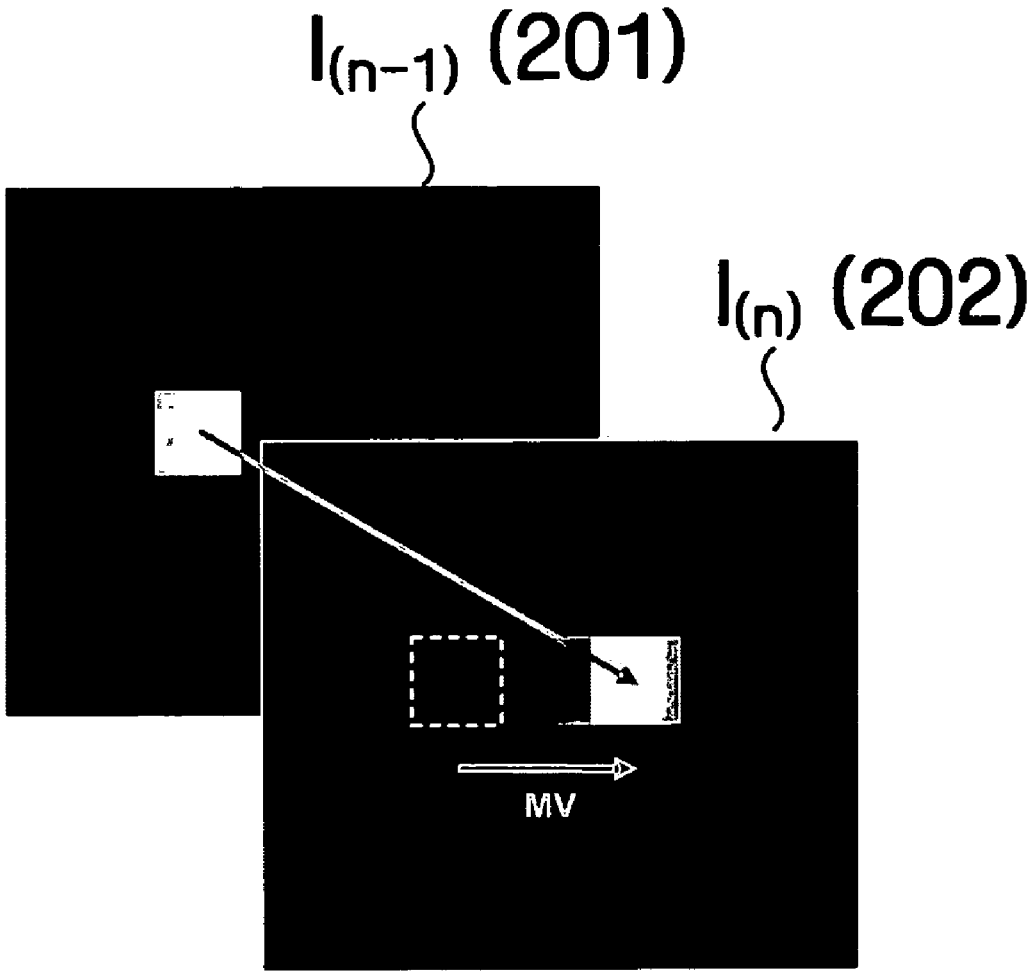
FIG. 2 (PRIOR ART)
FIG. 2 is an exemplary illustration of the conventional phosphor persistence occurring near a moving object.

Reference will now be made in detail to embodiments of the present invention, examples of which are illustrated in the accompanying drawings, wherein like reference numerals refer to the like elements throughout. Embodiments are described below to explain the present invention by referring to the figures.

Figure 3:
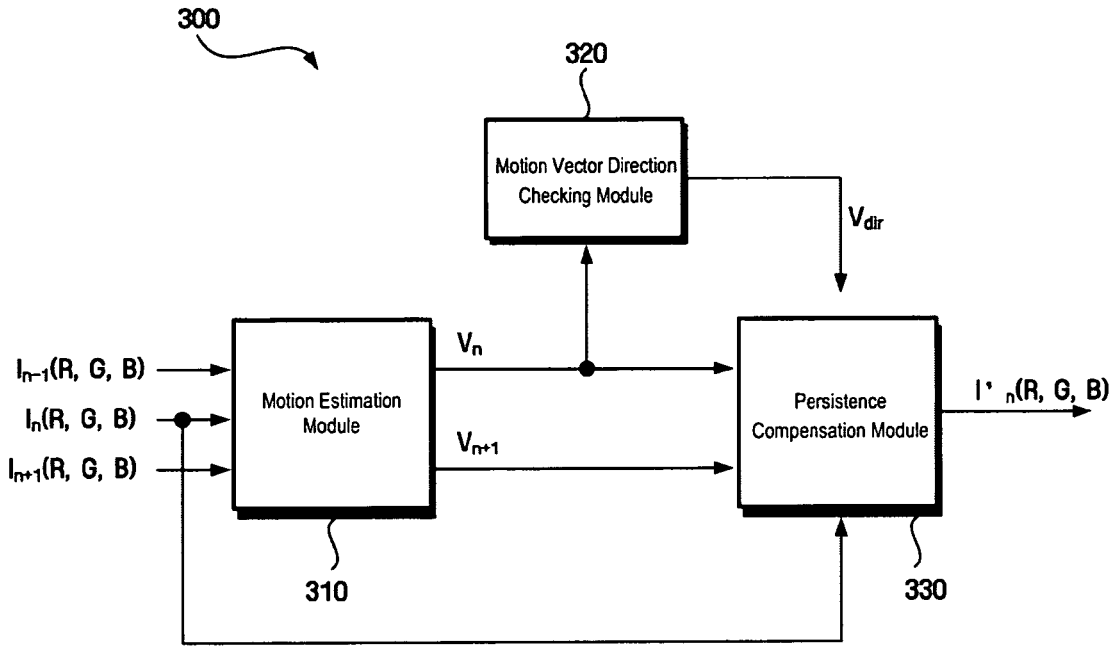
FIG. 3 illustrates a persistence compensation apparatus according to an embodiment of the present invention.

FIG. 3 illustrates a persistence compensation apparatus, according to an embodiment of the present invention. Referring to FIG. 3, the persistence compensation apparatus 300 may include a motion estimation module 310, a motion-vector direction-checking module 320, and a persistence-compensation module 330, for example.

The motion estimation module 310 may estimate a motion vector $V_n$, from the previous frame $I_{n-1}$ (R, G, B) and the current frame $I_n$ (R, G, B), and estimate a motion vector $V_{n+1}$ from the current frame $I_n$ (R, G, B) and the next frame $I_{n+}$,(R, G, B).

The motion-vector direction-checking module 320 may further receive the motion vector $V_n$ provided from the motion estimation module 310, and estimate the direction of the motion vector $V_n$ to output the estimated value to the persistence-compensation module 330.

Still further, the persistence-compensation module 330 may compensate for differences in persistence between phosphors based on the directional component $V_{dir}$ of the motion vector $V_n$, e.g., from the motion-vector direction-checking module 320, the motion vectors $V_n$ and $V_{n+1}$, e.g., from the motion estimation module 310, and reduce or color R, G, and B values of the current frame $I_n$ (R, G, B).

In an embodiment of the present invention, any type of motion estimation module 310 that can provide a motion vector for each pixel, for example, can be used. An example of such a motion estimation module is discussed in PCT Unexamined Publication No. WO01/024152.

In order to compensate for the differences in persistence of phosphors, according to embodiments of the present invention, mathematical modeling for the quantity of phosphor persistence may be set.

Such mathematical modeling can be based on the human visual characteristics using the response characteristics for the respective R, G, and B phosphors illustrated in FIG. 1.

Based on FIG. 1, the response time characteristics for the respective R, G, and B phosphors, after the transition from an "ON" state to an "OFF" state, can be expressed by the following Equations (2) through (4).

$$f_R(t)=a_R e^{-b_R t} \tag{2}$$

$$f_G(t)=a_G e^{-b_G t} \tag{3}$$

$$f_B(t)=a_B e^{-b_B t} \tag{4}$$

Figure 4:
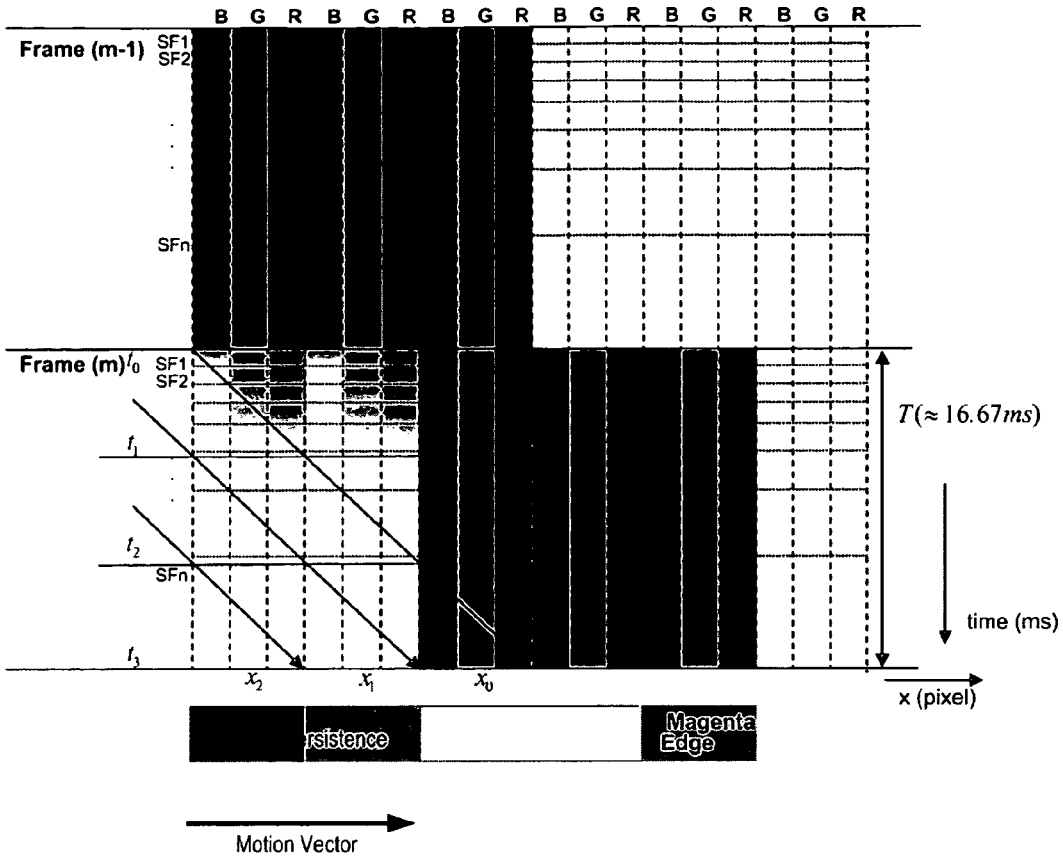
FIGS. 4 and 5 are graphs showing phosphor persistence recognized according to the response characteristics, arrangement of R, G, and B phosphors, and the direction of motion vectors.
Figure 5:
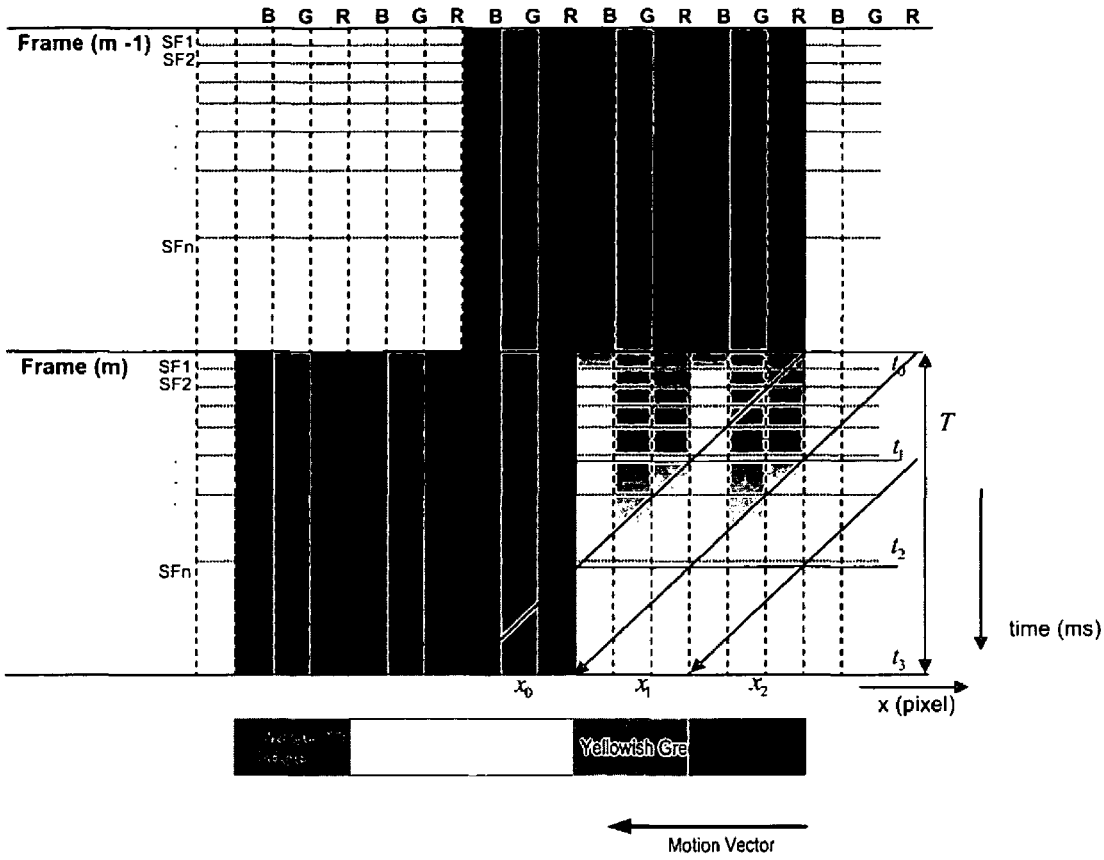

Also, temporally and spatially recognized quantities of phosphor persistence, which may be based on the response time characteristics of the R, G, and B phosphors, eye's tracking characteristic for a moving object, and visual characteristic recognized by integrating light incident to an eye, may be modeled with reference to FIGS. 4 and 5.

FIGS. 4 and 5 graphically illustrate phosphor persistence recognized according to the response characteristics and arrangement of R, G, and B phosphors and the direction of motion vectors. Further, FIG. 4 shows the phosphor persistence occurring when a white object, with a black background, horizontally moves in a positive direction of x-axis, and FIG. 5 shows the phosphor persistence occurring when a white object, with a black background, horizontally moves in a negative direction of x-axis.

Referring to FIG. 4, a white object in the (m−1)-th frame F(m−1) does not move on the y-axis, but moves in a positive direction of the x-axis, as far as two pixels, for one frame period, to form the m-th frame F(m). In this case, the respective frame may have a frame period of about 16.67 ms, for example, in the case of a PDP. In FIG. 4, illustrated $t_1$, $t_2$, and $t_3$ represent such corresponding times required for a human eye to track the moving white object for one pixel, and to corresponds to an initial time value.

In this case, a green persistence appears in the rear of the moving white object, and a magenta edge appears in the front of the object.

The quantity of phosphor persistence recognized in the rear of the object can be modeled by the below Equations (5) through (7), where $f_R$ (r), $f_G$ (r), $f_B$ (r) correspond to the above Equations (2) through (4), respectively.

$$g_R^+(x_l) = \sum_{i=l}^{|V|} \int_{i+2\Delta t}^{i+3\Delta t} f_R(t)dt \approx p_R^+ e^{-q_R^+ x_l} + c_R^+ \tag{5}$$

$$g_G^+(x_l) = \sum_{i=l}^{|V|} \int_{i+\Delta t}^{i+2\Delta t} f_G(t)dt \approx p_G^+ e^{-q_G^+ x_l} + c_G^+ \tag{6}$$

$$g_B^+(x_l) = \sum_{i=l}^{|V|} \int_{i}^{i+\Delta t} f_B(t)dt \approx p_B^+ e^{-q_B^+ x_l} + c_B^+ \tag{7}$$

Here, $$t_0 = 0,\quad t_i = \frac{T}{|V|+1}x_i,\quad \Delta t = \frac{t_1 - t_0}{3},\quad \text{and}\quad x_i = l,\quad l = 1, \ldots, V.$$

On the other hand, as illustrated in FIG. 5, a white object in the (m−1)-th frame F(m−1) may not move on the y-axis, but in a negative direction of the x-axis, as far as two pixels, for one frame period, to form the m-th frame F(m). In this case, the respective frame, for example, may have a frame period of about 16.67 ms in the case of a PDP. In FIG. 5, illustrated $t_1$, $t_2$, and $t_3$ represent such corresponding times required for a human eye to track the moving white object for one pixel, with $t_0$ corresponding to an initial time value.

In this case, a yellowish green persistence appears in the rear of the moving white object. This is different from the case illustrated in FIG. 4, as this persistence is caused by the different arrangement of the R, G, and B phosphors.

The quantity of phosphor persistence recognized in the rear of the object can be modeled by the below Equations (8) through (10), where $f_R(r)$, $f_G(r)$, $f_B(r)$ correspond to the above Equations (2) through (4), respectively.

$$g_{\bar{R}}(x_l) = \sum_{i=l}^{|V|} \int_{i}^{i+\Delta t} f_R(t)dt \approx p_{\bar{R}} e^{-q_{\bar{R}} x_l} + c_{\bar{R}} \tag{8}$$

$$g_{\bar{G}}(x_l) = \sum_{i=l}^{|V|} \int_{i+\Delta t}^{i+2\Delta t} f_G(t)dt \approx p_{\bar{G}} e^{-q_{\bar{G}} x_l} + c_{\bar{G}} \tag{9}$$

$$g_{\bar{B}}(x_l) = \sum_{i=l}^{|V|} \int_{i+2\Delta t}^{i+3\Delta t} f_B(t)dt \approx p_{\bar{B}} e^{-q_{\bar{B}} x_l} + c_{\bar{B}} \tag{10}$$

Here, $$t_0 = 0,\quad t_i = \frac{T}{|V|+1}x_i,\quad \Delta t = \frac{t_1 - t_0}{3},\quad \text{and}\quad x_i = l,\quad l = 1, \ldots, V.$$

Similarly, the quantity of phosphor persistence recognized in the rear of the white object moving in a certain direction can be modeled by the following Equations (11) through (13).

$$g_R(x_l) = \int_{l}^{T} f_R(t)dt \approx p_R e^{-q_R x_l} + c_R \tag{11}$$

$$g_G(x_l) = \int_{l}^{T} f_G(t)dt \approx p_G e^{-q_G x_l} + c_G \tag{12}$$

$$g_B(x_l) = \int_{l}^{T} f_B(t)dt \approx p_B e^{-q_B x_l} + c_B \tag{13}$$

Figure 6:
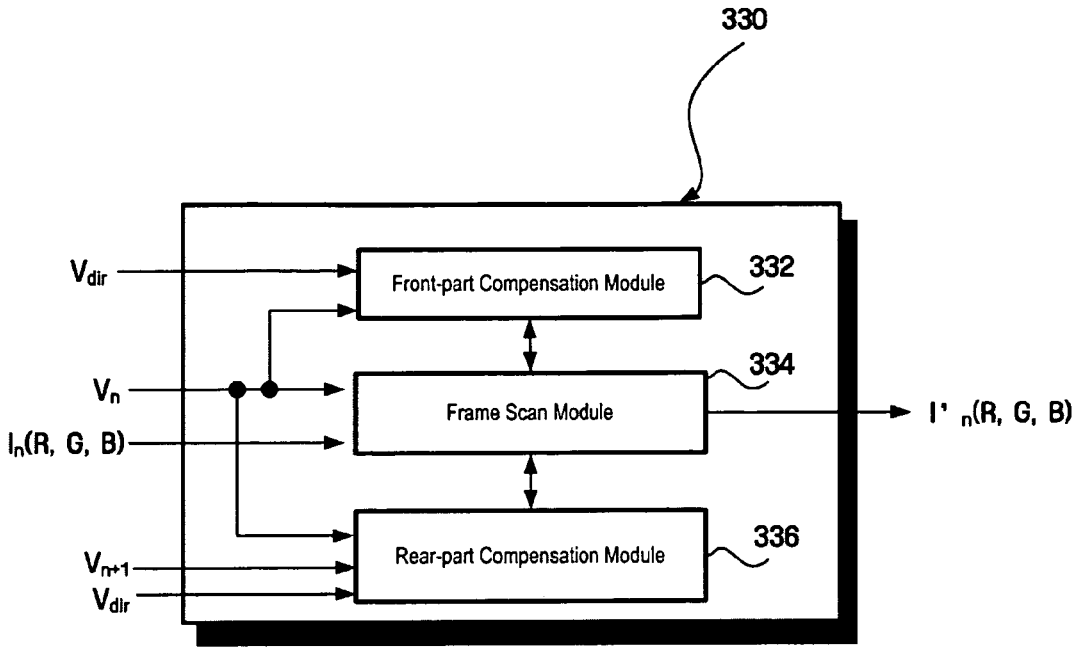
FIG. 6 illustrates a persistence-compensation apparatus, according to another embodiment of the present invention.

FIG. 6 illustrates a detailed construction of a persistence-compensation apparatus/module, according to an embodiment of the present invention. Referring to FIG. 6, the persistence-compensation module 330 may include a front-part compensation module 332, a frame scan module 334, and a rear-part compensation module 336, for example.

The frame scan module 334 may receive the n-th frame $I_n$ (R, G, B), and a motion vector $V_n$, from the motion estimation module 310, scan the frame $I_n$ (R, G, B) in the unit of a pixel, and provide a corrected frame obtained through a front-part compensation and a rear-part compensation according to the movement of the pixel.

If the pixel scanned by the frame scan module 334 is in the front area of a moving object, the front-part compensation module 332 may receive a directional component $V_{dir}$ of the motion vector $V_n$ from the motion-vector direction-checking module 320, for example, and the motion vector $V_n$ from the motion estimation module 310, for example, and perform persistence compensation on the front part of the moving object.

If the pixel scanned by the frame scan module 334 is in the rear area of the moving object, the rear-part compensation module 336 may receive the directional component $V_{dir}$ of the motion vector $V_n$ from the motion-vector direction-checking module 320, for example, and motion vectors $V_n$ and $V_{n+1}$ from the motion estimation module 310, for example, and perform persistence compensation on the rear part of the moving object.

In FIG. 6, it is exemplified that the frame corrected through the front or rear-part compensation may be output from the frame scan module 334. However, the frame corrected through the front-part compensation may alternately be output from the front-part compensation module 332, and the frame corrected through the rear-part compensation may alternately be output from the rear-part compensation module 336.

Figure 7:
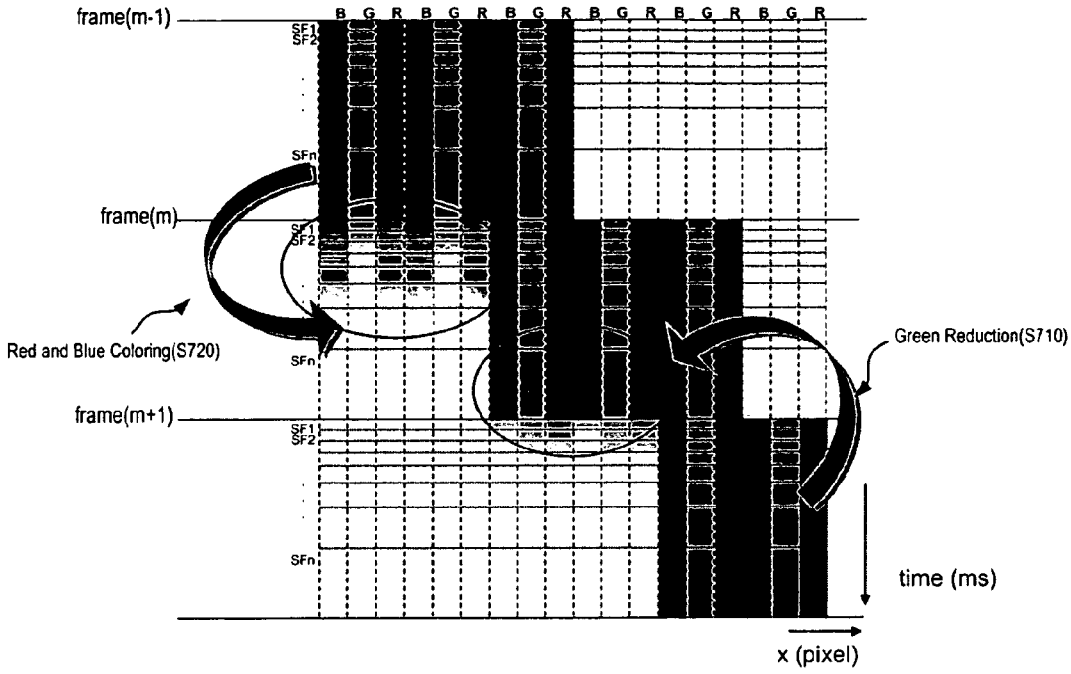
FIG. 7 illustrates a method of performing compensation on the rear part of a moving object, according to an embodiment of the present invention.

FIG. 7 illustrates a method of performing compensation on the rear part of a moving object, according to an embodiment of the present invention.

Referring to FIG. 7, an area where motion blur occurs in the rear of the moving object is reduced by reducing the green value with respect to the pixel $(1-k)V_{n+1}$ for the motion vector $V_{n+1}$, in operation S710. In this case, k may be in the range of $0<k<1$.

Then, by coloring red and blue on the pixel $kV_n$, for the motion vector $V_n$ based on the reduced green value, the phosphor persistence appearing in the rear of the moving object can then be compensated for, in operation S720.

Specifically, in order to compensate for the differences in persistence of phosphors occurring in the rear of the moving object, due to the differences in response time of light-emitting elements, video data for a light-emitting element (e.g., green phosphor among red, green, and blue phosphors) having a longest response time is reduced, and video data for alternate light-emitting elements (e.g., red and blue phosphors among red, green, and blue phosphors), having response times that are less than the longest response time, may be selected and compensated for based on the reduced video data of the light-emitting element with the longest response time.

Figure 8:
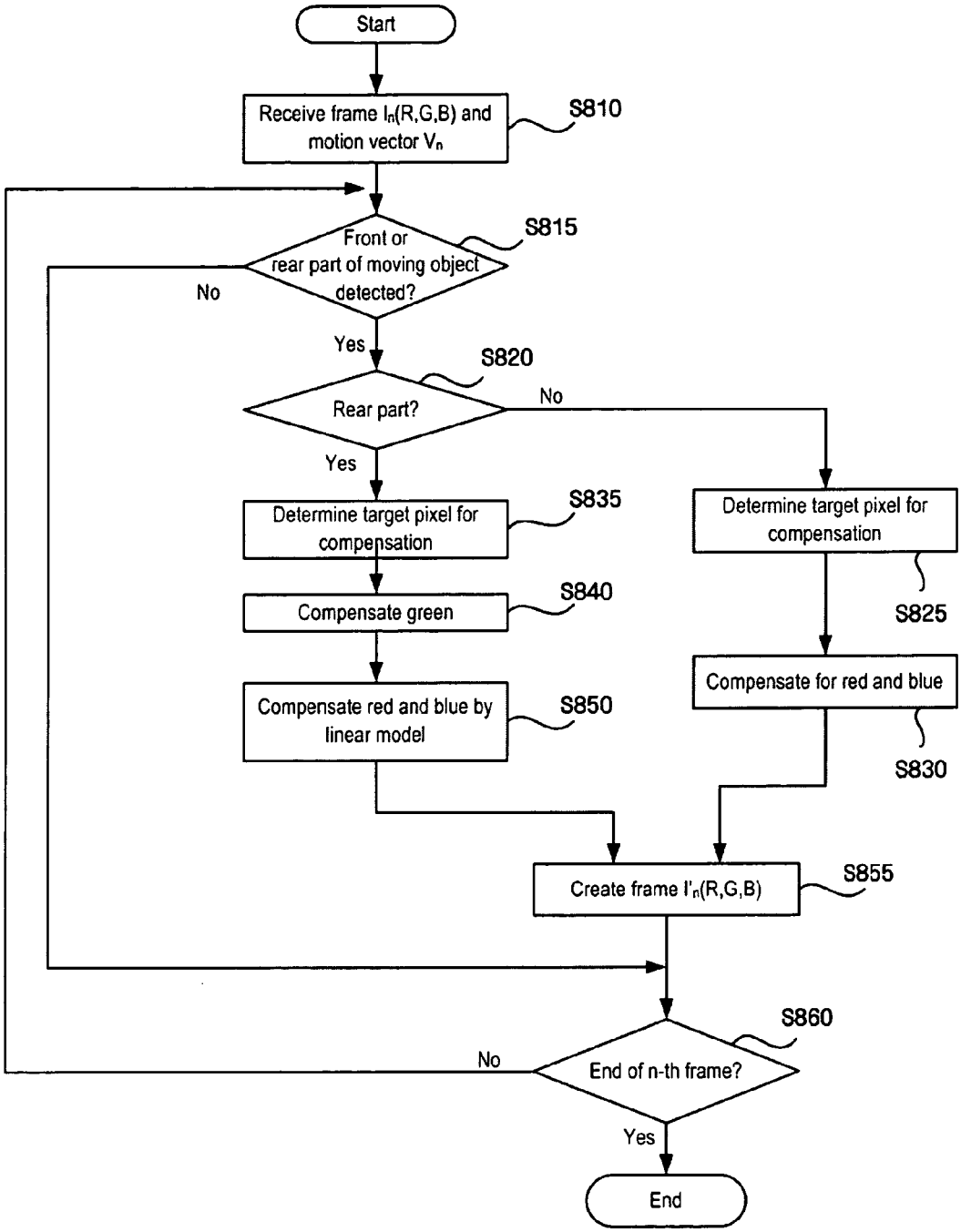
FIG. 8 illustrates a persistence compensation process, according to an embodiment of the present invention.

FIG. 8 illustrates a process of compensating for the differences in persistence of phosphors of a moving object, e.g., performed by the persistence-compensation module 330, according to an embodiment of the present invention. This process will be explained in detail with reference to FIG. 3 and FIG. 6.

First, the n-th frame $I_n$ (R, G, B) and the motion vector $V_n$, e.g., from the motion estimation module 310, may be received in the frame scan module 334, for example, of the persistence-compensation module 330, in operation S810.

Then, the frame $I_n$ (R, G, B) may be scanned, e.g., in the unit of a pixel, and whether the scanned pixel corresponds to the front or rear part of the moving object can be determined, in operation S815.

If the scanned pixel does not correspond to the front or rear part of the moving object, whether the scanning of the frame has been completed may be determined, in operation S860, and if so, the persistence compensation process for the current frame may be terminated, and the persistence compensation process for the next frame $I_{n+1}$ (R, G, B) may be performed. If the scanning of the frame has not been completed, as a result of the determination in operation S860, then operation S815 may be repeated.

Meanwhile, if the scanned pixel corresponds to the front part of the moving object, as determined in operation S815, a process of compensating for a color edge that occurs in the front of the moving object may be performed by the front-part compensation module 332, in operations S825 and S830, and if the scanned pixel corresponds to the rear part of the moving object ("Yes" in operation S820), a process of compensating for the differences in persistence of phosphors that occurs in the rear of the moving object may be performed by the rear-part compensation module 336, in operations S835, S840, and S850.

The process of compensating for the differences in persistence of phosphors occurring in the rear of the moving object may be performed in a manner that a target pixel for the compensation is determined, in operation S835, and then the motion vector $V_{n+1}$, e.g., received from the motion estimation module 310, and green emitted from the green phosphor, for example, which has the longest response time among the red, green, and blue phosphors, is compensated for, in operation S840.

Thus, if $I_g$ is a constant that represents the normal green level, the compensated green level $I'_g$ can be expressed by the following Equation (14).

$$I'_g = I_g - c \tag{14}$$

Here, c may be a constant value that can be experimentally obtained.

Accordingly, temporally and spatially recognized quantity of phosphor persistence for the green phosphor can be modeled according to the following Equation (15).

$$g_g(x) = a_g I'_g e^{-b_g x l |kV|} + c_g \tag{15}$$

Here, k may satisfy the range of $0<k\leqq 1$, and $a_g$, $b_g$, and $c_g$ may be constant values that can be experimentally obtained.

After green is compensated for, red and blue are then compensated for according to a linear model, in operation S850.

The temporally and spatially recognized quantities of persistence for the red and blue phosphors can, thus, be modeled as in the following Equations (16) and (17), respectively.

$$g_r(x) = a_r I_r e^{-b_r x l |kV|} + c_r \tag{16}$$

$$g_b(x) = a_b I_b e^{-b_b x l |kV|} + c_b \tag{17}$$

Figure 9:
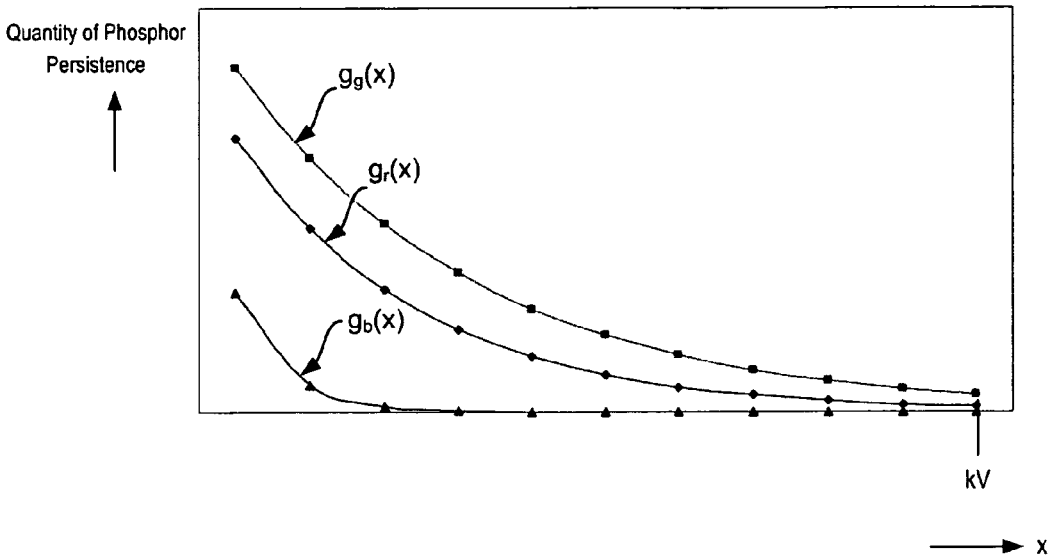
FIG. 9 is a graph showing a quantity of phosphor persistence recognized in the rear of a moving object, according to an embodiment of the present invention.

In the same manner, k may satisfy the range of $0<k<1$, and $a_r$, $b_r$, $c_r$, $a_b$, $b_b$, and $c_b$ may be constant values that can be experimentally obtained. $I_r$ and $I_b$ correspond to a normal red level and a blue level, respectively. FIG. 9 is a graph showing the respective recognized quantities of phosphor persistence, as expressed in Equations (15) through (17).

Accordingly, the quantities of persistence of the red and blue phosphors (i.e., phosphors that do not have the longest response time) may be compensated for so that they become equal to the quantity of persistence $g_g(x)$ of the green phosphor (i.e., phosphor having the longest response time). In such an embodiment, red and blue compensation quantities $h_r(x)$ and $h_b(x)$ can be derived according to the following Equations (18) and (19).

$$h_r(x) = g_g(x) - g_r(x) \tag{18}$$

$$h_b(x) = g_g(x) - g_b(x) \tag{19}$$

Figure 10:
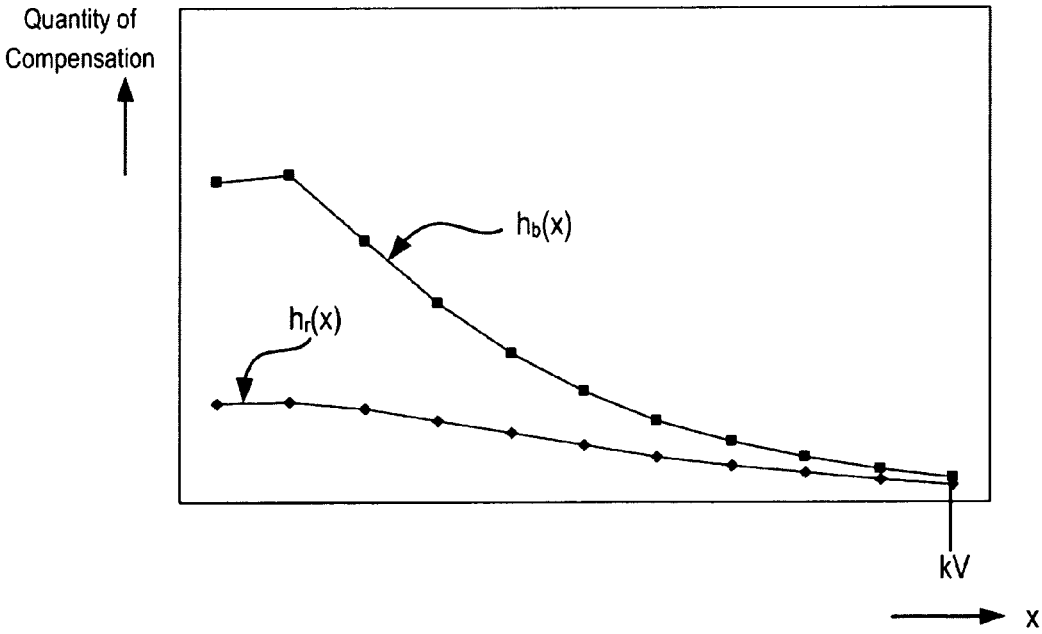
FIG. 10 is a graph showing a quantity of red and blue compensation, according to an embodiment of the present invention.

FIG. 10 is a graph showing red and blue compensation quantities, with $h_r(x)$ and $h_b(x)$ corresponding to red and blue coloring quantities used to reduce the respective persistence quantities, respectively.

Since Equations (18) and (19) are modeled in the form of a non-linear exponential function, a large amount of computation may be required for their actual implementation, which may result in the hardwired structure being complicated.

In order to simplify the computation, it may be helpful to linearize the red and blue compensation quantities. For this, the rear-part compensation module 336 of the persistence-compensation module 330 may use the directional component $V_{dir}$ of the motion vector $V_n$, e.g., from the motion-vector direction-checking module 320. Alternate conventional linearization methods may also be used.

If it is assumed that the linearized red and blue compensation quantities are $\omega_r^+(x), \omega_b^+(x)$ when a moving object does not move on the y-axis, but moves in a positive direction of the x-axis, i.e., when $V_x>0$ and $V_y=0$, $\omega_r^+(x), \omega_b^+(x)$ can be modeled according to the following Equations (20) and (21).

$$\omega_r^+(x) = I'_g(n_r^+ - m_r^+ x l |kV|) \tag{20}$$

$$\omega_r^+(x) = I'_g(n_b^+ - m_b^+ x l |kV|) \tag{21}$$

Conversely, if it is assumed that the linearized red and blue compensation quantities are $\omega_r^-(x), \omega_b^-(x)$ when a moving object does not move on the y-axis, but moves in a negative direction of the x-axis, i.e., when $V_x<0$ and $V_y=0$, $\omega_r^+(x), \omega_b^+(x)$ can be modeled according to the following Equations (22) and (23).

$$\omega_r^-(x) = I'_g(n_r^- - m_r^{-xl} |kV|) \tag{22}$$

$$\omega_b^-(x) = I'_g(n_b^- - m_b^{-xl} |kV|) \tag{23}$$

Figure 11:
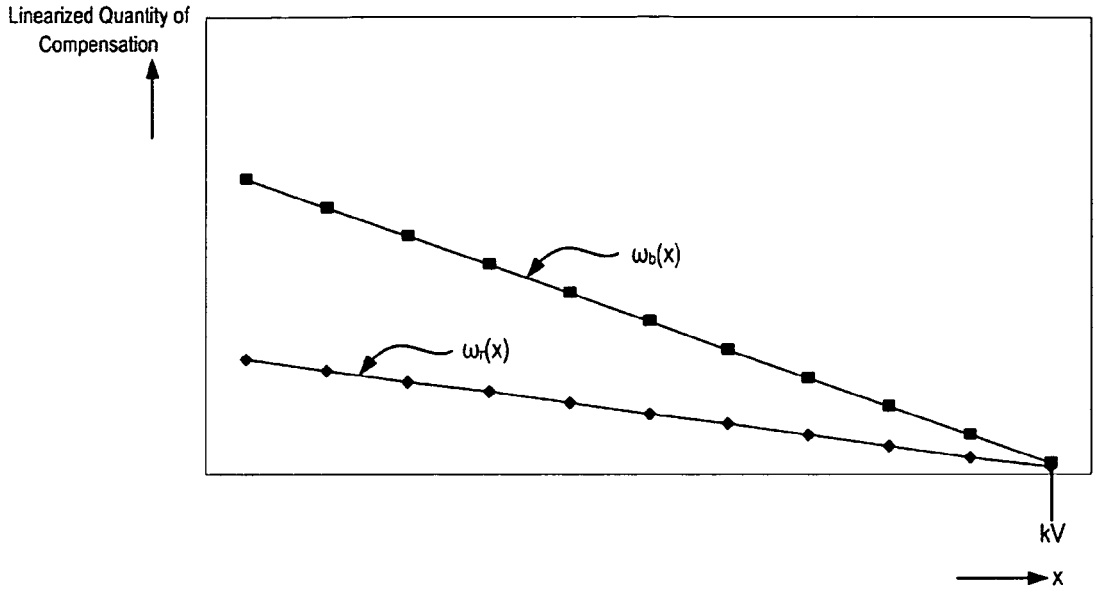
FIG. 11 is a graph showing a linear quantity of red and blue compensation with respect to an object moving in a certain direction, according to an embodiment of the present invention.

Thus, the linearized red and blue compensation quantities for an object that moves in a certain direction can be modeled according to the following Equations (24) and (25), as illustrated in the graph of FIG. 11.

$$\omega_r(x) = I'_g(n_r - m_r x l |kV|) \tag{24}$$

$$\omega_b(x) = I'_g(n_b - m_b x l |kV|) \tag{25}$$

If red and blue are compensated for by the linear model according to the above-described method, in operation S850, a compensated frame $I'_n$(R, G, B) may be created in operation S855.

Then, whether the currently scanned pixel corresponds to the last pixel of the current frame may be determined by the frame scan module 334 of the persistence-compensation module 330, in operation S860.

If the currently scanned pixel corresponds to the last pixel of the current frame, the persistence compensation process for the current frame may be terminated, and the persistence compensation process for the next frame $I'_{n+1}$(R, G, B) may be performed. If the currently scanned pixel does not correspond to the last pixel of the current frame, in operation S860, operation S815 may be repeated.

Meanwhile, if the scanned pixel does not correspond to the rear part of the moving object ("No" in operation S820), i.e., if the front part of the moving object is detected, a target pixel for the compensation may be determined, in operation S825, and red and blue may be compensated for by the front-part compensation module 332 of the persistence-compensation module 330, in operation S830.

In this case, the front-part compensation module 332 may receive the motion vector $V_n$, e.g., from the motion estimation module 310, and the directional component $V_{dir}$ of the motion vector $V_n$, e.g., from the motion-vector direction-checking module, and perform the compensation operation accordingly.

Hereinafter, this front part compensation operation will be explained in more detail.

In the front of the moving object, a color edge may be recognized. In this case, by reducing video data values of blue and red emitted from the blue and red phosphors having the short response time, the blue and red phosphors can be adjusted so as to emit light in the same quantity of light emission as the green phosphor having the longest response time. By doing this, the color edge is changed to gray, and thus it seems that the unnaturally colored shape disappears.

Figure 12:
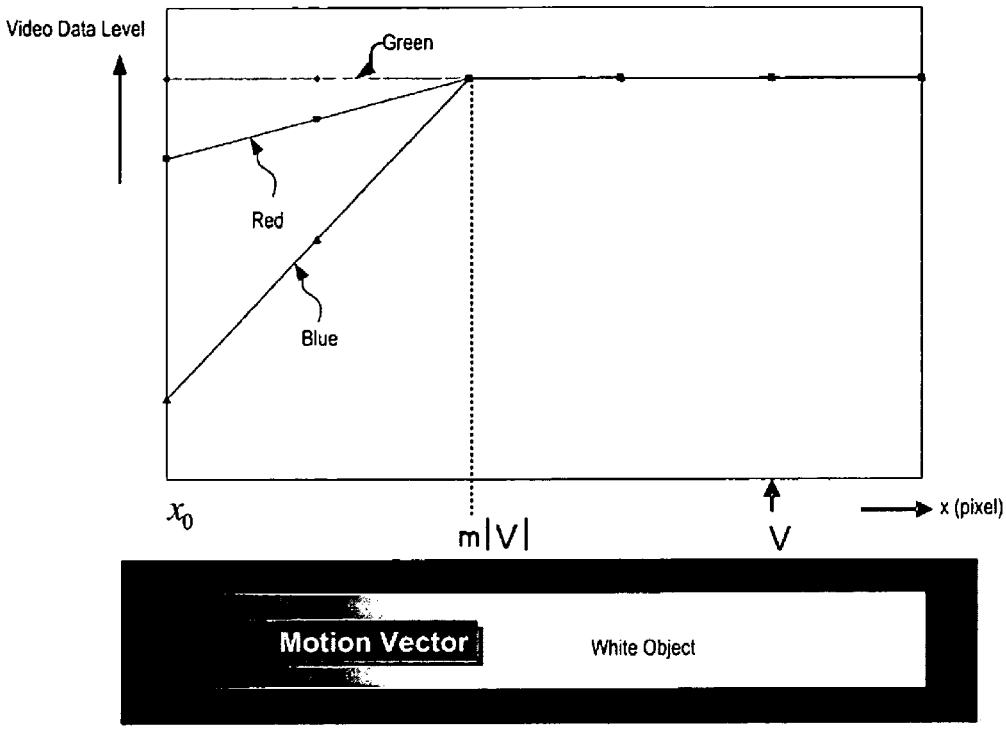
FIG. 12 is a graph showing R, G, and B levels with respect to a color edge appearing in front of a moving object, according to an embodiment of the present invention.

FIG. 12 is a graph showing video data levels of R, G, and B with respect to a color edge appearing in the front of a moving object, according to an embodiment of the present invention. The blue and red video data values can be linearly adjusted with reference to FIG. 12. In this case, the adjusted area may be in the range of a pixel x that satisfies the range of $x_0<x\leqq m|V|$(on condition that $0<m<1$).

When x satisfies the above range, on the assumption that values representing green, blue, and red levels are $I^g$, $I_b$, and $I_r$, the linearly adjusted blue and red data values can be modeled as in the following Equations (26) and (27), respectively.

$$h_B(x) = a_B I_g + x \times \frac{I_g - a_B I_g}{m|V|} \tag{26}$$

$$h_R(x) = a_R I_g + x \times \frac{I_g - a_R I_g}{m|V|} \tag{27}$$

Here, the condition of $0<m$, $a_B$, $a_R<1$ is satisfied.

That is, by reducing the video data levels of the pixel that corresponds to the front part of the moving object as much as $h_B(x)$ and $h_R(x)$, the appearance of the color edge can be reduced.

On the other hand, the color edge occurring in the front of the moving object can also be compensated for in consideration of the arrangement of R, G, and B and the direction of the motion vector. In this case, colors recognized at the front edge of the moving object may differ according to the arrangement of R, G, and B, and the color edge can be compensated for by differently adjusting the slope of a compensation model according to the direction of the motion vector.

For example, here it is assumed that the arrangement of R, G, and B is in the order of B-G-R.

In this case, in order to compensate for a reddish magenta edge that is recognized in the front of the object which does not move on the y-axis, but moves in a positive direction of the x-axis, the linearly adjusted blue and red video data values can be modeled according to the following Equations (28) and (29).

$$h_B^+(x) = a_B^+ I_g + x \times \frac{I_g - a_B^+ I_g}{m|V|} \tag{28}$$

$$h_R^+(x) = a_R^+ I_g + x \times \frac{I_g - a_R^+ I_g}{m|V|} \tag{29}$$

Similarly, in order to compensate for a bluish magenta edge that is recognized in the front of the object which does not move on the y-axis, but moves in a negative direction of the x-axis, the linearly adjusted blue and red video data values can be modeled according to the following Equations (30) and (31).

$$h_B^-(x) = a_B^- I_g + x \times \frac{I_g - a_B^- I_g}{m|V|} \tag{30}$$

$$h_R^-(x) = a_R^- I_g + x \times \frac{I_g - a_R^- I_g}{m|V|} \tag{31}$$

In Equation (28) through Equation (31), $I_g$ denotes the video data value of green, and x satisfies the range of $x_0<x\leqq m|V|$ (on condition that $0<m<1$).

If red and blue are compensated for according to the above-described method, in operation S850, a compensated frame $I'_n$(R, G, B) may be created, in operation S855.

Then, whether the currently scanned pixel corresponds to the last pixel of the current frame may be determined through the frame scan module 334 of the persistence-compensation module 330, in operation S860.

If the currently scanned pixel corresponds to the last pixel of the current frame, the persistence compensation process for the current frame may be terminated, and the persistence compensation process for the next frame $I_{n+1}$(R, G, B) may be performed. If the currently scanned pixel does not correspond to the last pixel of the current frame, in operation S860, then operation S815 may be repeated.

Figure 13:
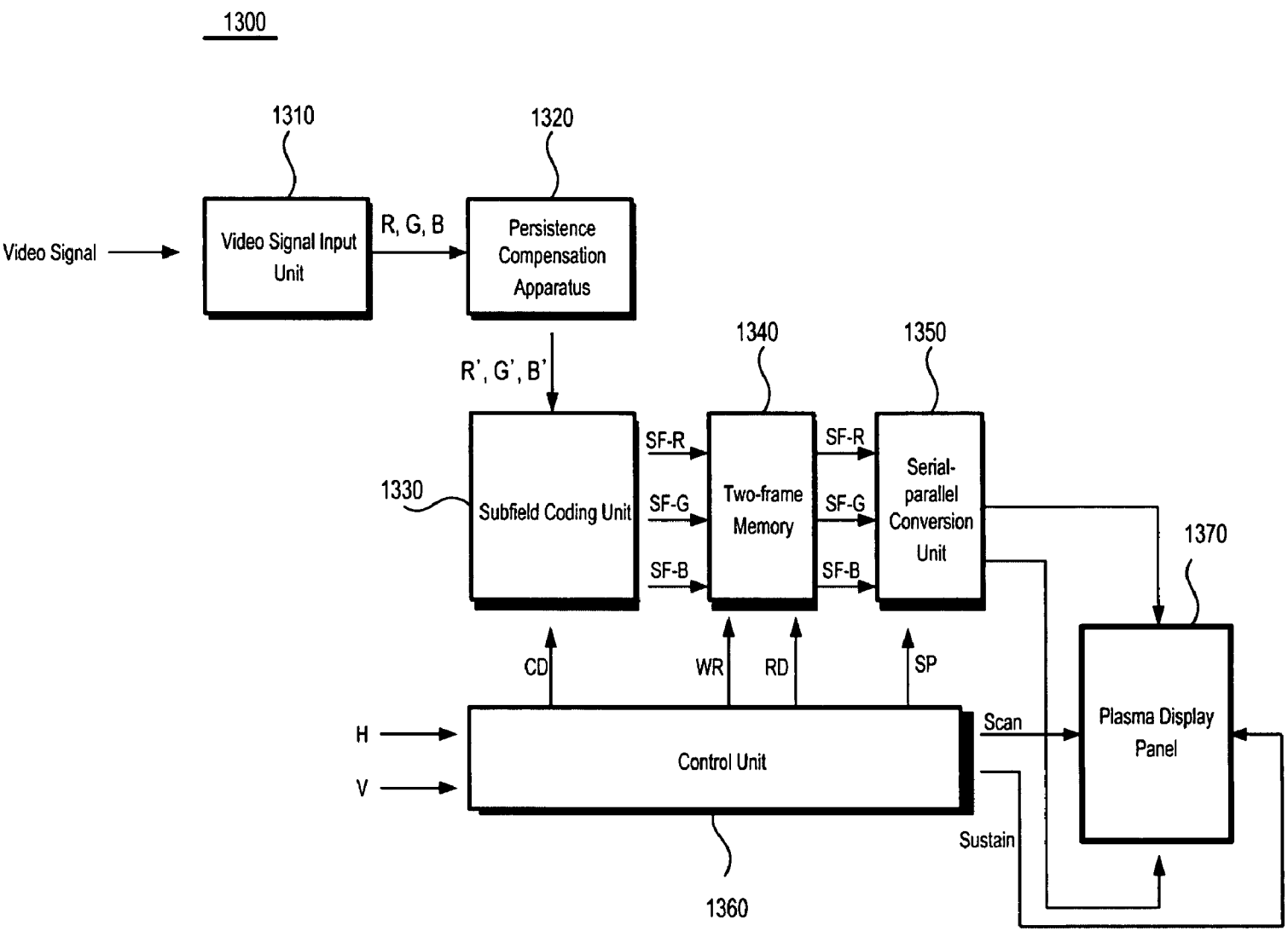
FIG. 13 illustrates a display device having persistence compensation, according to an embodiment of the present invention.

FIG. 13 illustrates a display device including persistence compensation according to an embodiment of the present invention. In FIG. 13, a PDP is illustrated as an example of the display device, noting that alternative display devices are equally available.

The display device 1300 may include a video signal input unit 1310, a persistence compensation apparatus 1320, a subfield coding unit 1330, a two-frame memory 1340, a serial-parallel conversion unit 1350, a control unit 1360, and a plasma display panel 1370, for example.

The video signal input unit 1310 may receive video signals of diverse forms, and converts them into R, G, and B signals.

The persistence compensation apparatus 1320 may perform persistence compensation of the R, G, and B signals, e.g., input from the video signal input unit 1310, and output the compensated R, G, and B signals to the subfield coding unit 1330.

The subfield coding unit 1330 may further perform subfield coding under the control of the control unit 1360, and generate subfield code words.

Thereafter, the two-frame memory 1340 may store the generated subfield code words. The read/write of the subfield code words from/to the two-frame memory 1340 may be controlled by the control unit 1360, and although not illustrated, the control unit 1360 may generate a timing signal for the control of the video signal input unit 1310 and the persistence compensation apparatus 1320.

For the addressing of the plasma display panel 1370, the subfield code words may be read out from the two-frame memory 1340, and the serial-parallel conversion unit 1350 may collect all the code words for one line and generate an extremely long code word to be used in addressing the plasma display panel 1370.

The control unit 1360 may, thus, receive vertical and horizontal sync signals as reference timing signals, and generate all scan and sustain pulse signals for the control of the plasma display panel 1370.

Again, although a plasma display panel has been described, with some exemplary modules, embodiments of the present invention are applicable to all display devices provided with sources having different response times against three colors.

As described above, according to embodiments of the present invention, an area where a motion blur occurs with respect to a moving object is reduced, and a color edge and a phosphor persistence that are generated in the front and rear of the moving object can be removed, in a display panel composed of two or more light-emitting elements having different response characteristics.

Above, embodiments of the present invention have been described with reference to the accompanying drawings, e.g., illustrating block diagrams and flowcharts, for explaining a method and apparatus for compensating for differences in persistence of phosphors in a display panel, for example. It will be understood that each block of such flowchart illustrations, and combinations of blocks in the flowchart illustrations, may be implemented by computer readable instructions of a medium. These computer readable instructions may be provided to a processor of a general purpose computer, special purpose computer, or other programmable data processing apparatus to produce a machine, such that the instructions, which execute via the processor of the computer or other programmable data processing apparatus, implement the functions specified in the flowchart block or blocks.

These computer program instructions may be stored/transferred through a medium, e.g., a computer usable or computer-readable memory, that can instruct a computer or other programmable data processing apparatus to function in a particular manner. The instructions may further produce another article of manufacture that implements the function specified in the flowchart block or blocks.

In addition, each block of the flowchart illustrations may represent a module, segment, or portion of code, for example, which makes up one or more executable instructions for implementing the specified logical operation(s). It should also be noted that in some alternative implementations, the operations noted in the blocks may occur out of order. For example, two blocks shown in succession may in fact be executed substantially concurrently or the blocks may sometimes be executed in the reverse order, depending upon the functionality involved.

In embodiments of the present invention, the term "module", as used herein, may mean, but is not limited to, a software or hardware component, such as a Field Programmable Gate Array (FPGA) or Application Specific Integrated Circuit (ASIC), which performs certain tasks. A module may advantageously be configured to reside on an addressable storage medium and configured to execute on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables, noting that alternative embodiments are equally available. In addition, the functionality provided for by the components and modules may be combined into fewer components and modules or further separated into additional components and modules. Further, such a persistence compensation apparatus, medium, or method may also be implemented in the form of a single integrated circuit, noting again that alternative embodiments are equally available.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of compensating for differences in response times of phosphors in light-emitting elements, the method comprising:

compensating data of a first light-emitting element that has a slowest response time;

compensating data of a second light-emitting element that has a response time shorter than a response time of the first light-emitting element, wherein the compensating of the data of the second light-emitting element is based on a difference between the response time of the first light-emitting element and the response time of the second light-emitting element and the compensation performed on the data of first light-emitting element.

2. The method of claim 1, wherein the data of the first light-emitting element is video data and the data of the second light-emitting element is video data.

3. The method of claim 1, wherein the compensating of the data of the first light-emitting element comprises reducing a level of the data based on motion vectors estimated from a current frame of the data of the first light-emitting element and a subsequent frame of the data of the first light-emitting element.

4. The method of claim 1, wherein the difference in response times would generate a visually noticeable color edge at a leading edge of a moving object without compensation of the data of the second light-emitting element.

5. The method of claim 1, wherein the difference in response times would generate a visually noticeable color persistence at a trailing edge of a moving object without compensation of the data of the first light-emitting element.

6. The method of claim 1, wherein the compensating of the data of the second light-emitting element comprises:

calculating a difference in a quantity of emitted light between a first quantity of emitted light corresponding to the compensated data of the first light-emitting element and a second quantity of emitted light corresponding to the data of the second light-emitting element; and compensating the data of the second light-emitting element based on the calculated difference in the quantity of emitted light.

7. The method of claim 1, the compensating of the data of the second light-emitting element comprises:

calculating a difference in a quantity of emitted light between a first quantity of emitted light corresponding to the compensated data of the first light-emitting element and a second quantity of emitted light corresponding to the data of the second light emitting element;

linearizing the calculated difference in the quantity of the emitted light; and compensating the data of the second light-emitting element based on the linearized calculated difference in the quantity of the emitted light.

8. The method of claim 7, wherein the linearization of the calculated difference in the quantity of the emitted light includes linearizing based on motion vectors estimated from a previous frame of the data of the second light-emitting element and a current frame of the data of the second light-emitting element, and directional components of the motion vectors.

9. The method of claim 1, wherein the first light-emitting element comprises a green phosphor, and the second light-emitting element comprises a red phosphor or a blue phosphor.

10. A method of compensating for differences between response times of phosphors in light-emitting elements, the method comprising:

compensating for a data value of a second light-emitting element, which has a shorter response time than a response time of a first light-emitting element that has a slowest response time, based on non-phosphors response time compensated data of the first light-emitting element; and making the second light-emitting element emit a quantity of light such that, in combination with light generated by at least another light-emitting element and/or the first light- emitting element, corresponding response time differences between light-emitting elements are visually less detectable than a combination of light generated without compensation of the data value of the second light-emitting element.

11. The method of claim 10, wherein the combination of light of the second light-emitting element and the at least other light-emitting element and/or the first light-emitting element produces a gray color at a color edge, of an object, created by the second light-emitting element.

12. The method of claim 11, wherein the color edge is a movement leading edge of the object.

13. The method of claim 10, wherein the response time difference would generate a visually noticeable color edge at a leading edge of a moving object without compensation of the data value of the second light-emitting element.

14. The method of claim 10, wherein the compensated data value is based on motion vectors of a corresponding moving object.

15. The method of claim 10, wherein the first light-emitting element includes a green phosphor, and the second light-emitting element includes a red phosphor or a blue phosphor.

16. An apparatus compensating for differences in response times of phosphors in a corresponding plurality of first light-emitting elements and a plurality of second light-emitting elements, with each of the plurality of second light-emitting elements having shorter response times than each of the corresponding plurality first light-emitting elements that have a slowest response time, the apparatus comprising:

a compensating unit to compensate a data of a first light-emitting element, of the plurality of first light-emitting elements, with the data of the first light-emitting element controlling an emitting of light of the first light-emitting element, and to compensate data of a second light-emitting element, of the plurality of second light-emitting elements, with the data of the second light-emitting element controlling an emitting of light of the second light-emitting element, wherein the compensating of the data of the second light-emitting element is based on a difference between a response time of the first light-emitting element and a response time of the second light-emitting element and the compensation performed on the data of first light-emitting element.

17. The apparatus of claim 16, further comprising:

a control unit to receive reference timing signals and to generate scan signals; and a display, comprising the plurality of first light-emitting elements and the plurality of second light-emitting elements, to output light based upon the generated scan signals and respective compensated pixel data having compensated data of corresponding first light-emitting elements and compensated data of corresponding second light-emitting elements.

18. An apparatus compensating for differences in response times of phosphors in a corresponding plurality of first light-emitting elements and a plurality of second light-emitting elements, with each of the plurality of second light-emitting elements having shorter response times than each of the corresponding plurality first light-emitting elements that have a slowest response time, the apparatus comprising:

a compensating unit to compensate for a data value of a second light-emitting element, of the plurality of second light-emitting elements, with the data of the second light-emitting element controlling an emitting of light of the second light-emitting element, with the compensation of the data value of the second light-emitting element being based on non-phosphors response time compensated data of a first light-emitting element, of the plurality of first light-emitting elements, with the data of the first light-emitting element controlling an emitting of light of the first light-emitting element; and making the second light-emitting element emit a quantity of light such that, in combination with light generated by at least another light-emitting element and/or the first light-emitting element, corresponding response time differences between light-emitting elements are visually less detectable than a combination of light generated without compensation of the data value of the second light-emitting element.

19. The apparatus of claim 18, further comprising:

a control unit to receive reference timing signals and to generate scan signals; and a display, comprising the plurality of first light-emitting elements and the plurality of second light-emitting elements, to output light based upon the generated scan signals and respective compensated pixel data having non-phosphors response time compensated data of corresponding first light-emitting elements and compensated data of corresponding second light-emitting elements.

20. A display apparatus, comprising:

a control unit to receive reference timing signals and to generate scan signals; and a display, comprising a plurality of first light-emitting elements and a plurality of second light-emitting elements, to output light based upon the generated scan signals and respective compensated pixel data, wherein the compensated pixel data comprises compensating data of a first light-emitting element, of the first light-emitting elements, that has a slowest response time and compensating data of a second light-emitting element, of the second light-emitting elements, which has a response time shorter than a response time of the first light-emitting element, wherein the compensating of the data of the second light-emitting element is based on a difference between the response time of the first light-emitting element and the response time of the second light-emitting element and the compensation performed on the data of first light-emitting element, when the difference in the response time would generate a visually noticeable color persistence at a trailing edge of a moving object without compensation of the data of the first light-emitting element, and wherein the compensated pixel data comprises compensating the data of the second light-emitting element, based on non-phosphors response time compensated data of the first light-emitting element, and making the second light-emitting element emit a quantity of light such that, in combination with light generated by at least another light-emitting element and/or the first light-emitting element, a corresponding response time difference between corresponding pixel light-emitting elements are visually less detectable than a combination of light generated without compensation of the data of the second light-emitting element, when the corresponding response time difference would generate a visually noticeable color edge at a leading edge of a moving object without compensation of the data value of the second light-emitting element.

21. An apparatus compensating for differences in response times of phosphors of light-emitting elements, the apparatus comprising:

a motion estimation module to estimate a first motion vector from a previous video frame and a video current frame, and to estimate a second motion vector from the video current frame and a subsequent video frame;

a motion-vector direction-checking module to generate a directional component of the estimated first motion vector; and a response time-compensation module compensating for the differences in the response times of the phosphors of the light-emitting elements, including compensating a slowest response time light-emitting element, based on the generated directional component, the estimated first motion vector, and the estimated second motion vector, to adjust video data values of the current frame.

22. The apparatus of claim 21, wherein the response time-compensation module comprises:

a frame scan module to scan the current frame;

a front-part compensation module to receive the generated directional component of the first motion vector of the estimated first motion vector and the estimated motion vector, and to perform response time compensation on a front part of a moving object if a pixel scanned by the frame scan module is included in the front part of the moving object; and a rear-part compensation module to receive the generated directional component of the first motion vector of the estimated first motion vector and the estimated first and second motion vectors, and performing response time compensation on a rear part of the moving object if the pixel scanned by the frame scan module is included in the rear part of the moving object.

23. The apparatus of claim 22, wherein the front-part compensation module makes at least one second light-emitting element emit a same quantity of emitted light as a first light-emitting element that has the slowest response time, with a response time of the second light-emitting element being different than a response time of the first light-emitting element, by reducing the response time of the second light-emitting element.

24. The apparatus of claim 23, wherein the reduced response time of the second light-emitting element is adjusted according to a direction of the first motion vector.

25. The apparatus of claim 23, wherein the first light-emitting element includes a green phosphor, and the second light-emitting element includes a red phosphor or a blue phosphor.

26. The apparatus of claim 22, wherein the rear-part compensation module compensates for differences in the response time of phosphors due to a difference between response times of first and second light-emitting elements, with the response time of the first light-emitting element having the slowest response time and being longer than a response time of the second light-emitting element, by reducing a response time of the first light-emitting element, and compensates for the response time of the second light-emitting element.

27. The apparatus of claim 26, wherein the response time of the first light-emitting element is reduced based on the second motion vector.

28. The apparatus of claim 26, wherein the rear-part compensation module calculates a difference in an amount of emitted light between a first light emission corresponding to the reduced response time of the first light-emitting element and a second light emission corresponding to the response time of the second light-emitting element, and compensates for the response time of the second light-emitting element based on the calculated difference in the amount of emitted light.

29. The apparatus of claim 26, wherein the rear-part compensation module calculates a difference in an amount of emitted light between a first light emission corresponding to the reduced response time of the first light-emitting element and a second light emission corresponding to the response time of the second light-emitting element, linearizes the calculated difference in the amount of emitted light, and compensates for the response time of the second light-emitting element based on the linearized calculated difference in the amount of emitted light.

30. The apparatus of claim 29, wherein the linearization is performed using the estimated first motion vector and the generated directional component of the first motion vector.

31. The apparatus of claim 26, wherein the first light-emitting element includes a green phosphor, and the second light-emitting element includes a red phosphor or a blue phosphor.

32. A display apparatus, comprising:

a video signal input unit to receive and convert a video signal of a specified form into red (R), green (G), and blue (B) signals;

a response time-compensation unit to compensate for determined differences in response times of light-emitting elements for -the R, G, and B signals, including a slowest response time light-emitting element, as corresponding corrected R, G, and B signals;

a subfield coding unit to generate subfield code words by using the corrected R, G, and B signals;

a two-frame memory to store the generated subfield code words;

a serial-parallel conversion unit to collect all code words for one line from the two-frame memory and to perform an addressing according to the one line;

a plasma display panel to output the corrected R, G, and B signals corresponding to the addressing; and a control unit to receive vertical and horizontal sync signals as reference timing signals and to generate scan and sustain pulse signals for control of the plasma display panel.

33. At least one medium comprising computer readable code to implement the method of claim 1.

34. At least one medium comprising computer readable code to implement the method of claim 10.

* * * * *

UNITED STATES PATENT AND TRADEMARK OFFICE

CERTIFICATE OF CORRECTION

PATENT NO. : 7,773,060 B2
APPLICATION NO. : 11/483848
DATED : August 10, 2010
INVENTOR(S) : Hyun-hwa Oh et al.

It is certified that error appears in the above-identified patent and that said Letters Patent is hereby corrected as shown below:

Column 16, Line 45, after "claim 1," insert --wherein--.

Column 17, Line 13, delete "light- emitting" and insert --light-emitting--, therefor.

Column 20, Line 41, delete "-the" and insert --the--, therefor.

Signed and Sealed this
Twenty-eighth Day of December, 2010

David J. Kappos

David J. Kappos
*Director of the United States Patent and Trademark Office*